United States Patent [19]

Kim

[11] 4,305,410

[45] Dec. 15, 1981

[54] ASHTRAY WITH DEVICES FOR EXTINGUISHING SMOKING CIGARETTES

[76] Inventor: Jung S. Kim, 474 Joongang-Dong, Sokcho-Si, Kangweon-Do, Rep. of Korea

[21] Appl. No.: 115,564

[22] Filed: Jan. 28, 1980

[51] Int. Cl.[3] ..... A24F 13/20; A24F 19/14

[52] U.S. Cl. ..... 131/237

[58] Field of Search ..... 131/235 R, 237, 231, 131/240 R

[56] References Cited

U.S. PATENT DOCUMENTS 2,573,391 10/1951 Bonanos ..... 131/237 X 3,108,602 10/1963 Rosner ..... 131/237

FOREIGN PATENT DOCUMENTS 455598 4/1949 Canada ..... 131/237

*Primary Examiner*—Stephen C. Pellegrino

*Attorney, Agent, or Firm*—McAulay, Fields, Fisher, Goldstein & Nissen

[57] ABSTRACT

An ashtray is provided with devices for extinguishing smoking cigarettes, including an open socket under which is affixed coacting pincers. These may be a pair of spring biased plates or a thin plate having a small diameter hole therethrough. Pincer action is attained by making radial cuts about the hole to produce a saw-tooth spring edge.

When a smoking cigarette is inserted through the pincer arrangement, the edges of the pincers pinch the end of the smoking cigarette just behind the hard, burning tip. Withdrawal of the cigarette causes the burning tip portion to be pushed off allowing it to fall automatically into a reservoir in the bottom of the ashtray.

5 Claims, 10 Drawing Figures

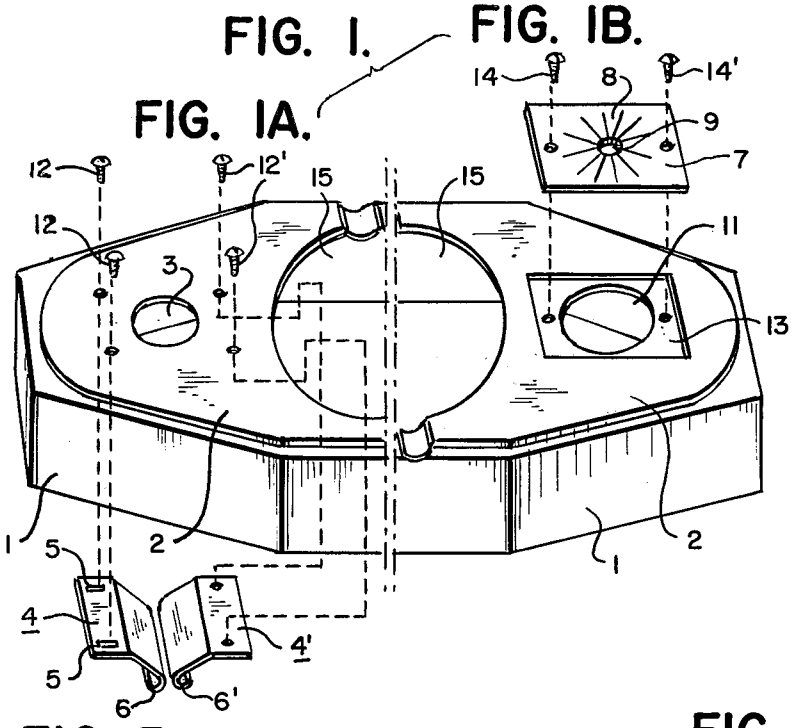
FIG. 1.
FIG. 1A.
FIG. 1B.
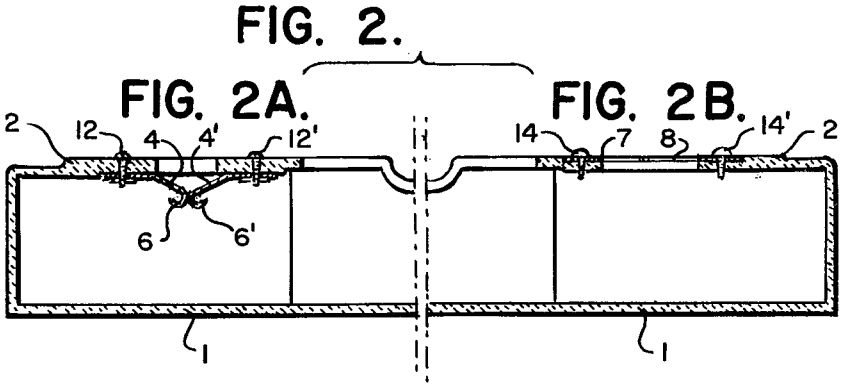
FIG. 2.
FIG. 2A.
FIG. 2B.
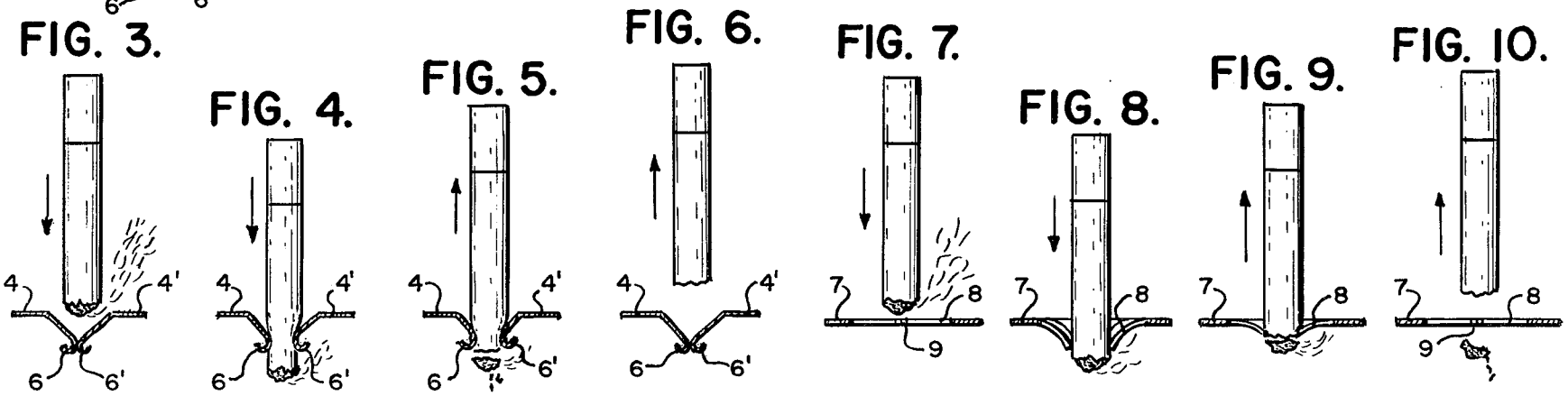
FIG. 3.
FIG. 4.
FIG. 5.
FIG. 6.
FIG. 7.
FIG. 8.
FIG. 9.
FIG. 10.

ASHTRAY WITH DEVICES FOR EXTINGUISHING SMOKING CIGARETTES

BACKGROUND OF THE INVENTION

This invention relates to cigarette ashtrays, and more particularly to ashtrays provided with appliances to automatically remove the burning tip, leaving the unused portion suitable for reuse at a later time.

This invention uses the fact that the end of a smoking cigarette, that is, the burning portion, becomes firmer and harder than the unburned portion of the cigarette. Thus, when a pair of pincers pinch the end of the cigarette, they will deform the unburned portion behind the burning tip. Pulling the cigarette out of the pincers will cause the harder end portion of the smoking cigarette to be pushed from the cigarette. One is thereby left with a cigarette butt devoid of ashes and the burning tip, which cigarette butt can be reused at a later time.

At the present time, there are many kinds of ashtrays with appliances for extinguishing smoking cigarettes. However, they all employ additional materials, such as water or sand which require that the water or sand be changed frequently. Also, any remaining cigarette butt is rendered useless.

They are therefore inconvenient to use and can, on occasion, cause unexpected fires.

A feature of the invention is the provision of a new ashtray with appliances for extinguishing a smoking cigarette in a safe and easy manner, leaving the butt suitable for reuse.

BRIEF DESCRIPTION OF THE DISCLOSURE

Briefly, an ashtray is provided with appliances for extinguishing smoking cigarettes in the form of a pair of coacting pincers disposed below a socket opening or hole. The pincers may be two steel or aluminium plates with springs, preferably, biasing the plates together to form a V-shaped cavity. When a smoking cigarette is inserted downwardly into the V-cavity and between the pincers, the edges of the pincers grasp and slightly deform the soft non-burning end of the smoking cigarette just behind the tip. Upon withdrawal of the cigarette, the hard, burning portion, is pinched off allowing it to fall automatically into a reservoir at the bottom of the ashtray. The cigarette is thereby automatically divided into two parts: a cigarette butt which can be reused, and an ash or burnt residue which remains at the bottom of the ashtray.

BRIEF DESCRIPTION OF THE DRAWINGS

FIGS. 1A and 1B which together form FIG. 1 are perspective views, partially exploded of two embodiments of the invention to show two coating pincer arrangements according to the present invention;

FIGS. 2A and 2B are respectively cross-sectional views of FIGS. 1A and 1B;

FIG. 3 is a cross-sectional view illustrating a burning cigarette prior to insertion into a first pincer arrangement embodiment shown in FIG. 1A on the left side of FIG. 1;

FIG. 4 is a cross-sectional view illustrating the insertion of the smoking cigarette downwardly into the pincer arrangement of FIG. 3;

FIG. 5 is a cross-sectional view showing the burning tip being pushed off as the cigarette is withdrawn from between the pincer arrangement of FIG. 3;

FIG. 6 is a cross-sectional view showing the complete removal of the cigarette from the pincer arrangement of FIG. 3, with the burnt tip residue removed and falling to the bottom of the ashtray;

FIG. 7 is a cross-sectional view illustrating a smoking cigarette prior to being inserted between a modified pincer arrangement according to the present invention, as shown in FIG. 1B on the right side of FIG. 1;

FIG. 8 is a cross-sectional view showing the insertion of a burning cigarette downwardly between the modified pincer arrangement of FIG. 7;

FIG. 9 is a cross-sectional view showing the cigarette being withdrawn from between the modified pincer arrangement with the burning tip of the cigarette trapped between the pincer edges; and, FIG. 10 is a cross-sectional view of the modified pincers showing the complete removal of the cigarette from the pincers, with the burnt tip residue falling to the bottom of the ashtray.

DETAILED DESCRIPTION OF THE PREFERRED EMBODIMENTS

Reference will now be made in detail to the present preferred embodiments of the invention, examples of which are illustrated in the accompanying drawings. In accordance with this invention, an ashtray with appliances for extinguishing smoking cigarettes will remove and retain the burnt tip portion of a smoking cigarette.

FIGS. 1 and 2 show an ashtray displaying two embodiments of the present invention appliances for extinguishing a smoking cigarette. The ashtray includes a cover or lid 2 on a body 1, forming a reservoir for the burning ashes.

FIGS. 3, 4, 5, and 6 show the structure and use of one embodiment of the invention. On one side of the cover 2 there is a socket opening or hole 3, whose diameter is larger than a cigarette. Inside this hole 3 is a coacting pair of pincers 4 in the form of spring-biased plates formed of steel or aluminium plates which springs extend under cover 2 and, which are affixed to the interior of the cover 2 by four bolts 12 or other equivalent means. One of the plates preferably has elliptically shaped bolt holes 5 to allow for position adjustments to be made.

In the embodiment of FIGS. 3–6, the upper part of the plates are spaced in order to permit proper insertion of the cigarette, and the ends 6, 6' of the plates 4, 4' contact each other and are bent and rounded. This forms the V-shaped cavity shown in FIGS. 3–6.

Referring to FIGS. 1 and 2, on the right side there is illustrated an embodiment including an opening 11 through cover 2, surrounded by a plate receiving depression 13 wherein fits plate 7. Plate 7 has a cigarette receiver opening 9 with radial cuts forming sawtooth edges 8 thereabout to give a spring-like action to plate 7. As is shown in FIGS. 7–10, the hole 9 is smaller than the diameter of a cigarette. This results in a pincer-like assembly wherein opposed ones of the sawtooth edges 8 operate in a manner analogous to the operation shown in FIGS. 3–6 (compare FIGS. 3–6 and 7–10) to remove the burning tip of a cigarette.

The thin plate 7 is affixed to the ashtray by two bolts 14. No elongated adjusting holes are necessary as with the embodiment of FIGS. 3–6, as the spacing of the sawtooth edges 8 is fixed.

In addition, the ashtray 1 can be used in a usual fashion for discarding cigarettes by discarding the cigarettes into the central opening 15.

As noted above, the elasticity of the plates 4, 4' generates the pincer action for the embodiment of FIGS. 3–6. To adjust the pressure, adjustment of the space between both plates 4, 4' is necessary. This is accomplished by forming the holes 5 for the bolts 12, in an elliptical shape. This permits shifting the plates 4, 4' with respect to each other. In order to provide smooth pincer spring action, the ends 6, 6' of the plates are preferable bent into a rounded configuration (FIGS. 3–6).

This invention uses the fact that the burning end of a smoking cigarette becomes hard as compared to the unburned portion of the cigarette so that when a smoking cigarette is inserted into the hole, the pincer assembly springs apart to permit the cigarette to pass through in a downward direction. However, when the cigarette is withdrawn from the pincers, the hard non-flexible end cannot pass back through (FIGS. 5 and 8) and is captured between or by the pincers. In this way the cigarette is automatically divided into two parts: A cigarette butt which can be reused, and an ashy or burnt residue, which is pushed off the cigarette and drops to the bottom of the ashtray.

The above is by way of illustration of the presently preferred embodiments. However, as other modifications and additions can be made within the scope of the invention, the above illustrations are not intended to be limiting.

What is claimed is:

1. In an ashtray having a body forming a reservoir for burning ashes, and a cover therefor, a device for extinguishing a cigarette comprising:

said cover having a cigarette receiving opening for receiving, therethrough, a burning cigarette for extension into said reservoir;

pincer means coupled with said cover extending into said reservoir operable to receive therein a burning cigarette, said pincer means comprising at least a pair of coacting spring means disposed apart a distance less than the diameter of the cigarette to restrain the passage therethrough and into said reservoir of the hard burning tip of the cigarette, whereby, when the cigarette is withdrawn from between said spring means, the hard burning tip is pushed off of the end of the cigarette and falls into said reservoir.

2. The ashtray of claim 1 wherein said coacting spring means comprise;

a pair of plates; and, a pair of springs having a part connected with said plates and including downwardly extending bent portions supporting one edge of each of said plates, said springs being operable to press the opposite edge of said plates together to form a V-shaped cavity.

3. The ashtray of claim 2 wherein said part of at least one of said springs includes elliptical mounting holes whereby it is secured to said ashtray with a fastener, to allow adjustment of the spacing between said springs.

4. The ashtray of claim 1 wherein said pincer means comprises;

a thin plate having a hole defined therethrough, said hole having a diameter less than the diameter of a cigarette;

and radial cuts disposed in said plate around the hole to form sawtooth edges, whereby opposed said sawtooth edges form said pair of coacting spring means.

5. The ashtray of claim 1 wherein said plate comprises:

a thin plate having a hole therethrough, said hole having a diameter less than that of a cigarette;

and radial cuts disposed around the hole to form sawtooth edges to provide resiliency and a spring-like action.

* * * * *